US007637725B2

(12) United States Patent
Berger

(10) Patent No.: US 7,637,725 B2
(45) Date of Patent: Dec. 29, 2009

(54) VARIABLE OUTPUT GEROTOR PUMP

(75) Inventor: Alvin H Berger, Brownstown, MI (US)

(73) Assignee: Ford Global Technologies, Dearborn, MI (US)

( * ) Notice: Subject to any disclaimer, the term of this patent is extended or adjusted under 35 U.S.C. 154(b) by 560 days.

(21) Appl. No.: 10/904,120

(22) Filed: Oct. 25, 2004

(65) Prior Publication Data

US 2006/0088431 A1 Apr. 27, 2006

(51) Int. Cl.
*F01C 1/02* (2006.01)

(52) U.S. Cl. ..... 418/61.3; 418/78

(58) Field of Classification Search ..... 418/61.3, 418/78

See application file for complete search history.

(56) References Cited

U.S. PATENT DOCUMENTS 3,892,710 A * 7/1975 Anderson et al. ..... 524/208
4,739,865 A * 4/1988 Yater et al. ..... 192/18 A
5,145,329 A * 9/1992 Zumbusch et al. ..... 417/356
5,722,815 A 3/1998 Cozens
5,738,501 A 4/1998 Eisenmann
6,161,643 A * 12/2000 Bober et al. ..... 180/249
6,238,315 B1 * 5/2001 Morse et al. ..... 475/88
6,709,245 B2 * 3/2004 Bachmann ..... 417/310
6,736,965 B2 * 5/2004 Cousineau et al. ..... 210/104

FOREIGN PATENT DOCUMENTS

CN 1434911 A 8/2003
DE 10207348 A1 9/2002
EP 1 091 126 A1 6/2000

* cited by examiner

*Primary Examiner*—Hoang M Nguyen
(74) *Attorney, Agent, or Firm*—Julia Voutyras; Jerome Drouillard

(57) ABSTRACT

A variable output gerotor pump includes outer and inner driven and driving rotors and an annular output control ring which is rotatable within a bore mounted within the pump's body so as to change the amount of working fluid which is transferred from the inlet port to the outlet port of the pump. This is particularly useful for controlling the output flow of lubricating oil used in an internal combustion engine.

2 Claims, 10 Drawing Sheets

Figure 8
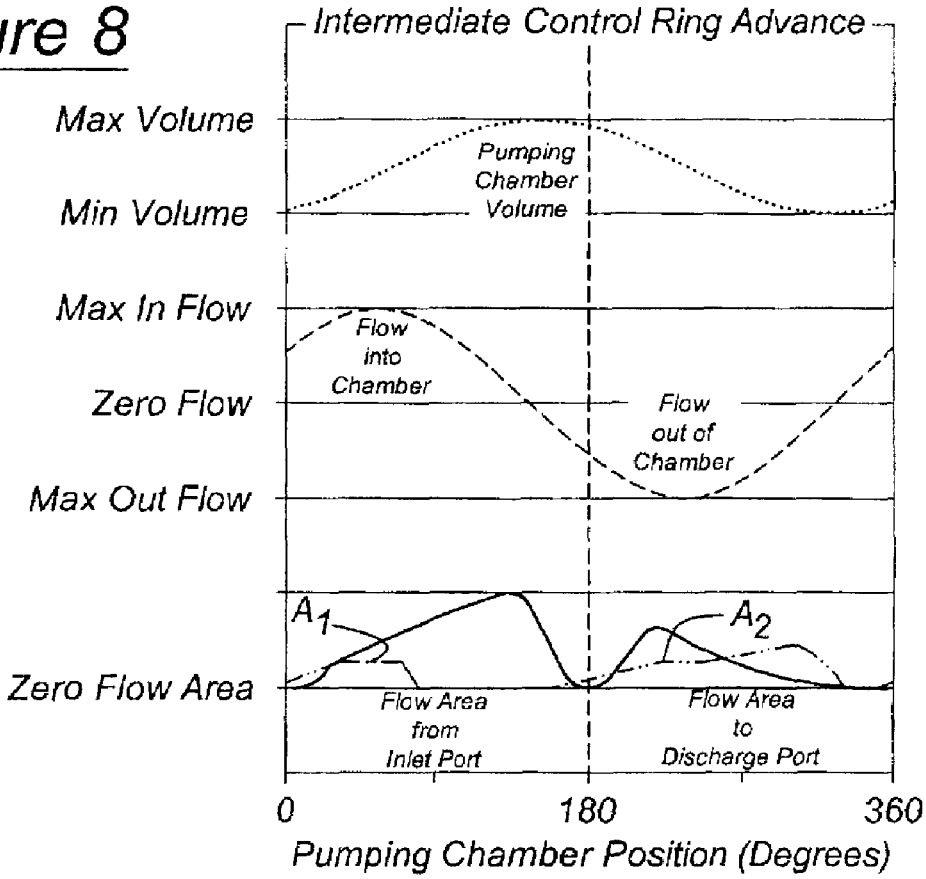
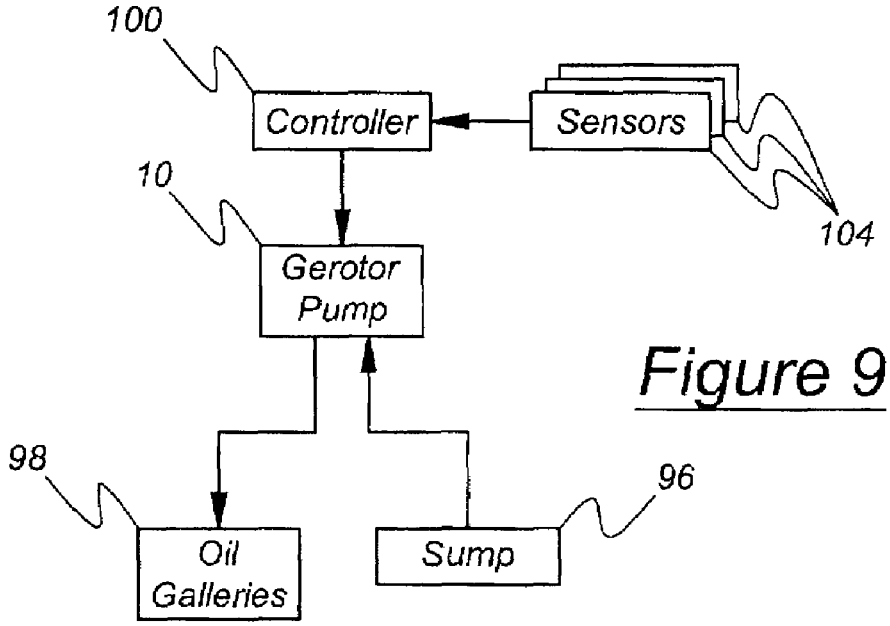
Figure 9

VARIABLE OUTPUT GEROTOR PUMP

BACKGROUND OF THE INVENTION

1. Field of the Invention

The present invention relates to a fluid gear pump of the gerotor type, which is suited for use as a lubricant pump within machinery such as an automotive engine.

2. Disclosure Information

Gerotor lubricating oil pumps have been used for years within automotive engines. U.S. Pat. No. 5,738,501 discloses a gear pump in which internal valving is used to adjust the amount of fluid being discharged from the pump. A drawback of the pump disclosed in the '501 patent resides in the fact that the efficiency of the pump is impaired by the use of the illustrated internal passage output limiting system.

For any particular automotive engine, designers will typically specify a lubrication pump having a volume rate of flow which is sufficient to provide adequate lubrication under worst case conditions. Conditions which dictate maximum lubricant flow generally correspond to maximum temperature, high speed operation, whereas conditions which dictate maximum flow per pump revolution (conditions that dictate the pump's displacement) generally correspond to maximum temperature, low speed operation. Conventionally, a pressure regulating valve installed between the oil pump's outlet and inlet is the only control mechanism for the pump. In the event that the pressure differential between the outlet and inlet exceeds a set value, the pressure regulating valve limits the pressure differential by allowing some of the pump's outlet flow to return directly to the pump inlet, effectively bypassing the engine's lubrication circuit. This method of control wastes energy for two reasons: first, because oil which has been pumped to a high pressure is merely bled to some lower pressure location, the work needed to pressurize the oil is lost. Secondly, the engine's bearings do not always require oil pressure as high as the pressure regulating valve setting, and excessive oil flow through the bearings causes increased energy consumption by depressing the temperature of oil actually in contact with the bearing journals, thereby increasing the oil's viscosity and the shear work performed on the oil. In any case, fuel consumption needlessly increases. The present gerotor pump allows operation so as to control the volumetric output of the pump, thereby permitting the pump output to be matched to the engine's requirements.

SUMMARY OF THE INVENTION

A variable output gerotor pump includes an outer housing having a generally circular bore therein and a generally annular output control ring having a circular outer peripheral surface with a center, and a circular inner surface having a center which is offset from the center of the outer peripheral surface. The output control ring is rotatably mounted within a generally circular bore housed within the pump. An annular, driven outer rotor is mounted within the annular output control ring and has a circular outer peripheral surface matched to the inner surface of the output control ring. The driven outer rotor also has a toothed inner surface. An inner rotor is mounted to a rotatable shaft and is meshed to the toothed inner surface of the outer rotor. A control drive rotates the output control ring to a desired position so as to control the output of the pump. The control drive may comprise a hydraulic drive powered by the output of the pump, with a vane-sealed torque arm being mounted to the outer peripheral surface of the output control ring and moveable within an annular control cavity. A plurality of passages within the outer housing conduct fluid from an outlet port of the pump to the control cavity. A valve controls the flow of fluid from the output port through the plurality of passages. The control passages include at least a first passage for advancing the output control ring and a second passage for retarding the output control ring.

The output control ring further includes shunt passages which allow limited flow between the pumping chambers and the outlet and/or inlet ports. These shunt passages include at least one shunt passage having a non-constant flow area.

According to another aspect of the present invention, a pressure lubrication system for an internal combustion engine includes a source of lubricating oil, an oil pressure sensor for generating a pressure signal, a variable output gerotor pump for providing lubricating oil to the engine, and a controller operatively connected with the oil pump and with the pressure sensor. The controller operates the oil pump so as to control the flow output of the pump as a function of at least the pressure signal. The controller regulates or operates the oil pump output flow by controlling the rotational position of the previously described output control ring by metering oil from the pump's discharge port to a control cavity within which a control ring torque arm is located.

It is an advantage of a system according to the present invention that an engine equipped with present gerotor oil pump may be expected to use less fuel because the oil pump's throughput may be tailored to the engine's particular needs at any given point in time, without the need for wasteful bypassing of high pressure oil.

It is an advantage of the present invention that the gerotor oil pump according to this invention is easily controlled with a single solenoid valve or other suitable control valve mechanism known to those skilled in the art and suggested by this disclosure.

It is an advantage of the present invention that the gerotor oil pump described herein is output-controllable at a low cost because external plumbing and valves are not needed with the present system.

Other advantages, as well as objects and features of the present invention, will become apparent to the reader of this specification.

BRIEF DESCRIPTION OF THE DRAWINGS

FIGS. 6-8 illustrate various operating characteristics of a pump according to the present invention at various output control ring advances.

FIG. 9 illustrates a block diagram of a system according to the present invention.

DETAILED DESCRIPTION OF THE PREFERRED EMBODIMENTS

Figure 1:
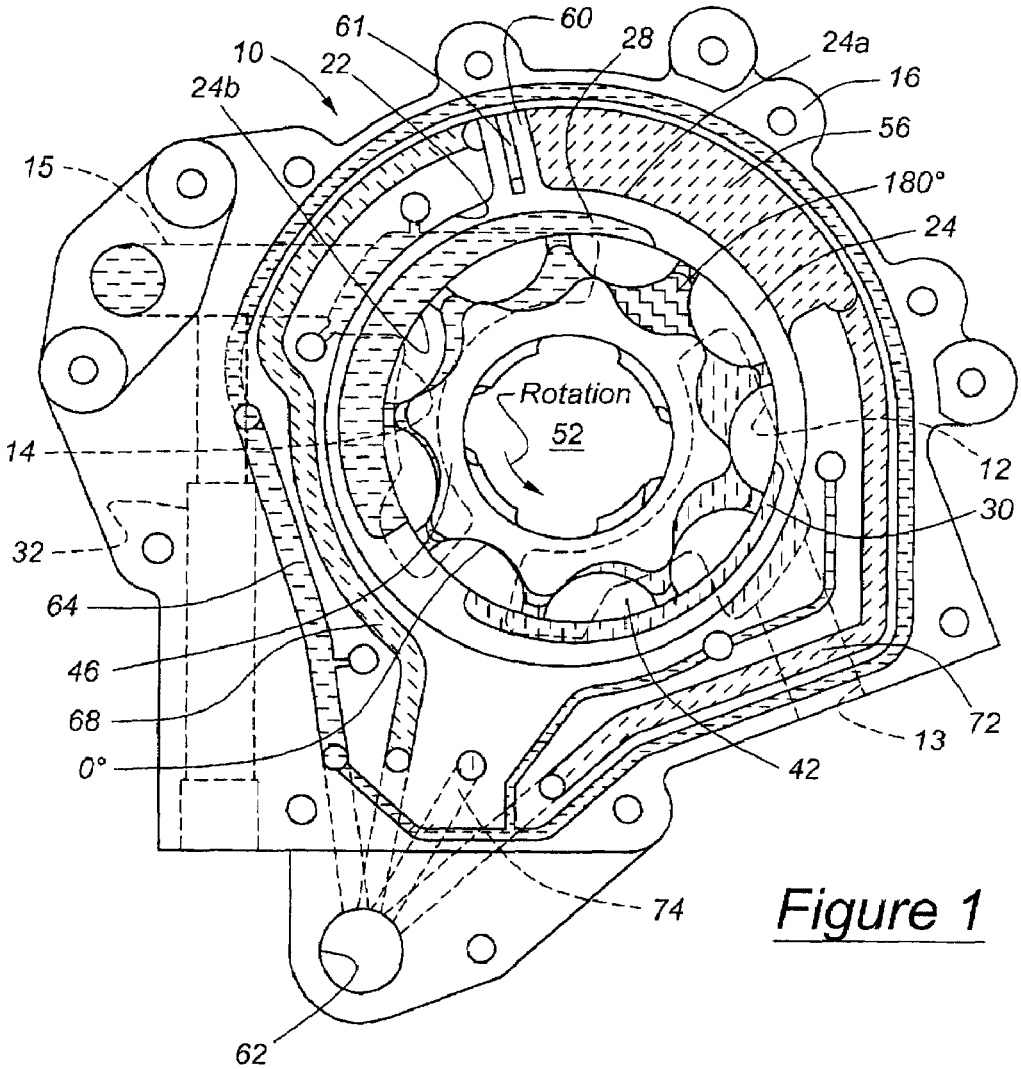
FIG. 1 illustrates a gerotor pump according to the present invention in a maximum flow position, with no advance of the output control ring. For the sake of clarity, the oil pump cover plate is not shown.

As shown in FIG. 1, gerotor pump 10 has inlet port 12 fed by pickup passage 13, and outlet port 14, which feeds discharge passage 15. Generally circular bore 22 is formed within pump body 16 and a gerotor pumping elements are housed within this generally circular bore 22. Output control ring 24 has a generally annular configuration with a circular outer peripheral surface, 24*a*, having a center. Output control ring 24 is mounted within generally circular bore 22. Output control ring 24 is rotatably positioned by means of fluid acting within annular control cavity 56, which exerts a fluid force on torque arm 60. In essence, torque arm 60 divides annular control cavity 56 into two chambers of variable size. Depending upon which chamber is pressurized, torque arm 60 and output control ring 24 will be caused to rotate, thereby changing the output of pump 10. Torque arm 60 carries a moveable vane, 61, which maintains a tight seal between the end of torque arm 60 and the outer wall of cavity 56. Pressure relief valve 32 is of conventional design.

As shown in FIG. 9, pump 10 picks up oil from a source such as sump 96, and sends the oil at a positive pressure to oil galleries 98. Controller 100 is operatively connected with oil pump 10 and with a number of engine operating parameter sensors, 104, including at least an oil pressure sensor, and optionally, engine speed and oil temperature sensors. Controller 100 operates solenoid valve 76 (described below), so as to control the volumetric output of pump 10.

Figure 3:
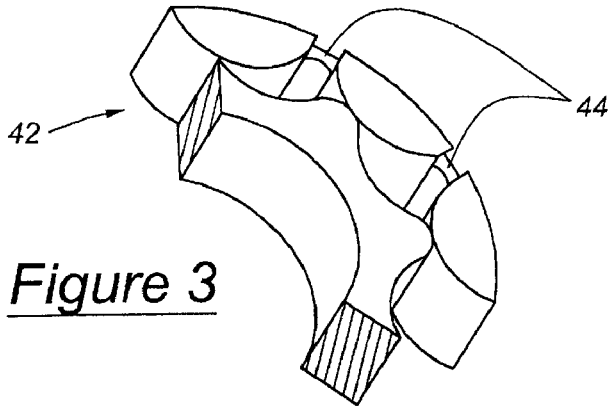
FIG. 3 illustrates a gerotor set useful for practicing the present invention.
Figure 4:
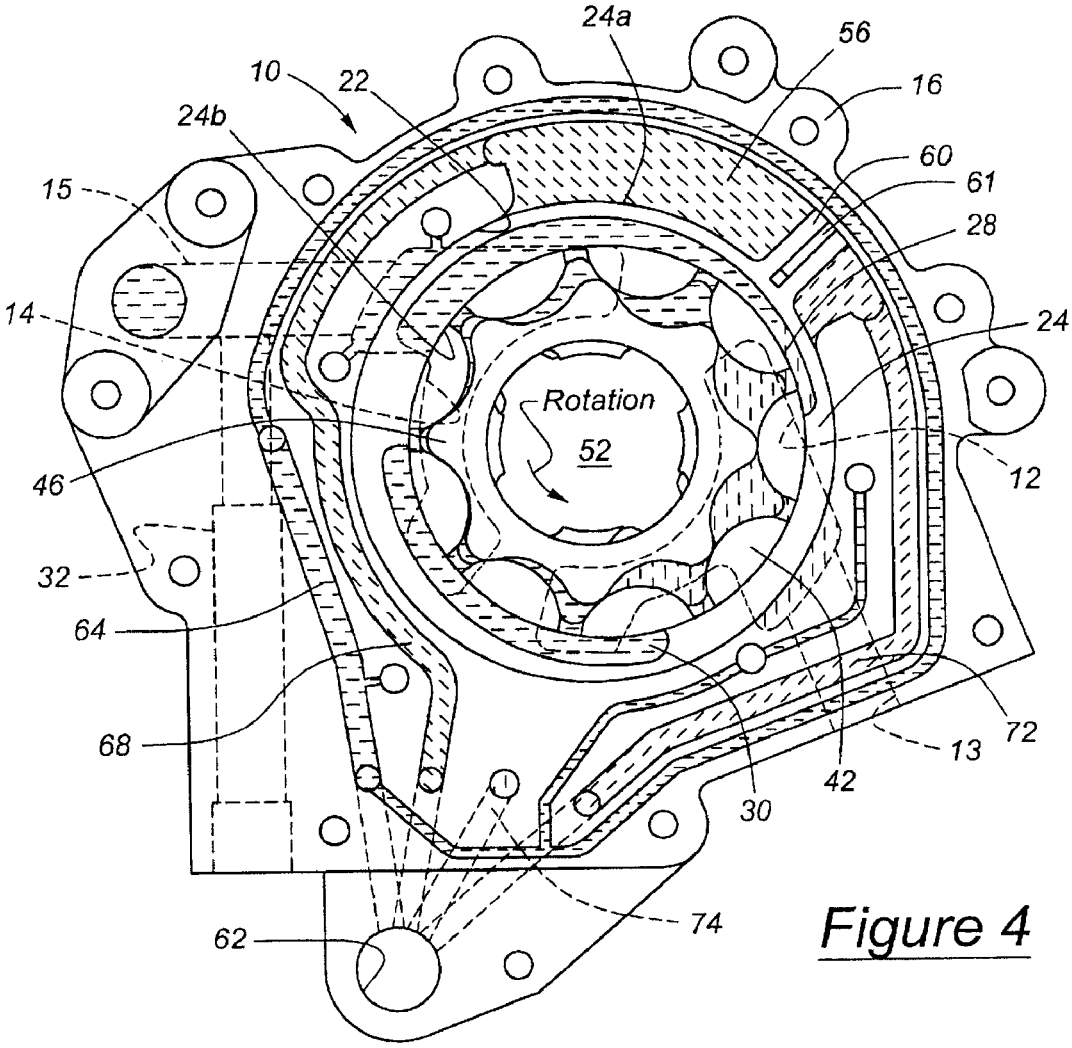
FIG. 4 illustrates the pump of FIG. 1 in a near maximum output control ring advance position.

Pump 10 uses a gerotor pumping system having an outer rotor 42 which is mounted within circular inner bore 24*b* of output control ring 24. Bore, 24*b*, as shown in FIGS. 1, 3 and 4, is formed eccentrically with respect to outer peripheral surface 24*a* of output control ring 24. As a result, rotation of output control ring 24 by means of torque arm 60, acting in response to unbalanced pressure within annular control cavity 56, will cause the output of the pump to change. This phenomenon will be described more fully below.

Inner rotor 46, which is mounted to driving shaft 52, has one tooth less than the number of teeth formed on outer rotor 42.

FIG. 1 shows pump 10 in a maximum flow position. With reference to the rotary positions through which the pumping chambers pass, these angular positions are measured relative to the pump's housing, with 0° being located between the outlet port and the inlet port, while 180° is located between the inlet port and the outlet port. The chamber passing through the 0° position has minimum volume, and the chamber passing through the 180° position has a maximum volume. As noted above, in FIG. 1 torque arm 60—and output control ring 24—are in the fully counterclockwise or retarded position, and as a result, the chamber passing through the 180° position has maximum volume. This means that the maximum amount of oil will be pumped, because the maximum amount of oil will be moved from inlet port 12 to outlet port 14 at the 180° position, while a minimum amount of oil will be moved from outlet port 14 to inlet port 12 at the 0° position.

Moving now to FIG. 4, which shows the near maximum advance position of output control ring 24, it may be seen that the parcel of oil moving from inlet port 12 to outlet port 14 is diminished considerably from that shown in FIG. 1 because the shifting of the eccentric output control ring 24 has allowed the pumping chambers to reach full volume and begin diminishing in volume while still in communication with the inlet port. At the 180° position, where the pumping chambers transfer oil from the inlet to the outlet port, the volume of the chambers is much less than when the eccentric output control ring 24 was at the maximum flow condition with zero advance. Also, the at the 0° position, where the pumping chambers transfer from the outlet to the inlet port, the chambers now carry a larger portion of oil from the outlet port to the input port, which further reduces the volume output of the pump.

Figure 5:
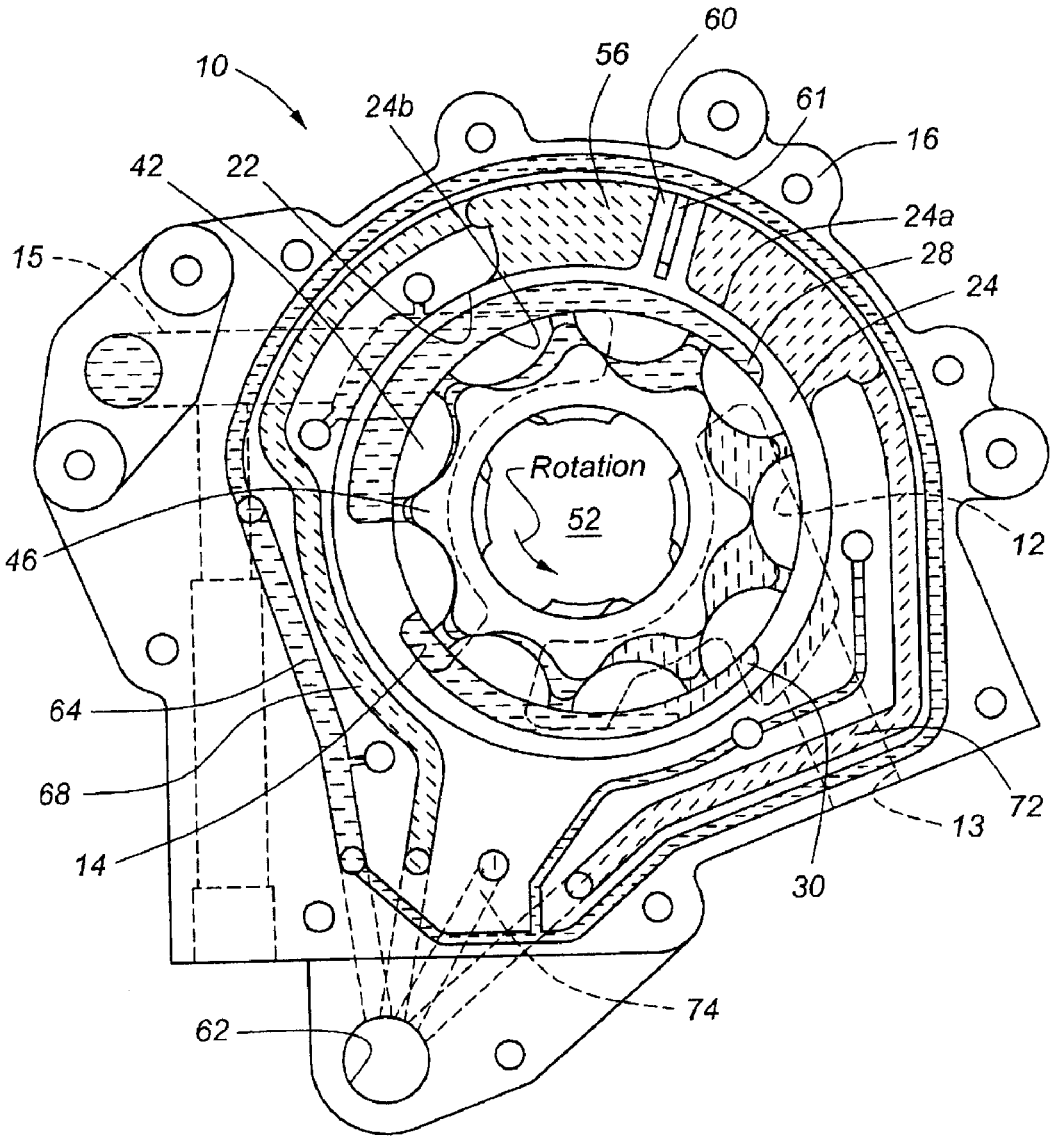
FIG. 5 is similar to FIGS. 1 and 4, but shows the present pump in an intermediate advance mode.

FIG. 5 illustrates an intermediate output control ring position between FIGS. 1 and 4, in which the volume of the 180° chamber is less than that of the zero advance (FIG. 1) but greater than that of the near maximum advance (FIG. 4), whereas the volume of the chamber at 0° is greater than that of the zero advance and less than that of the near maximum advance case.

Figure 6:
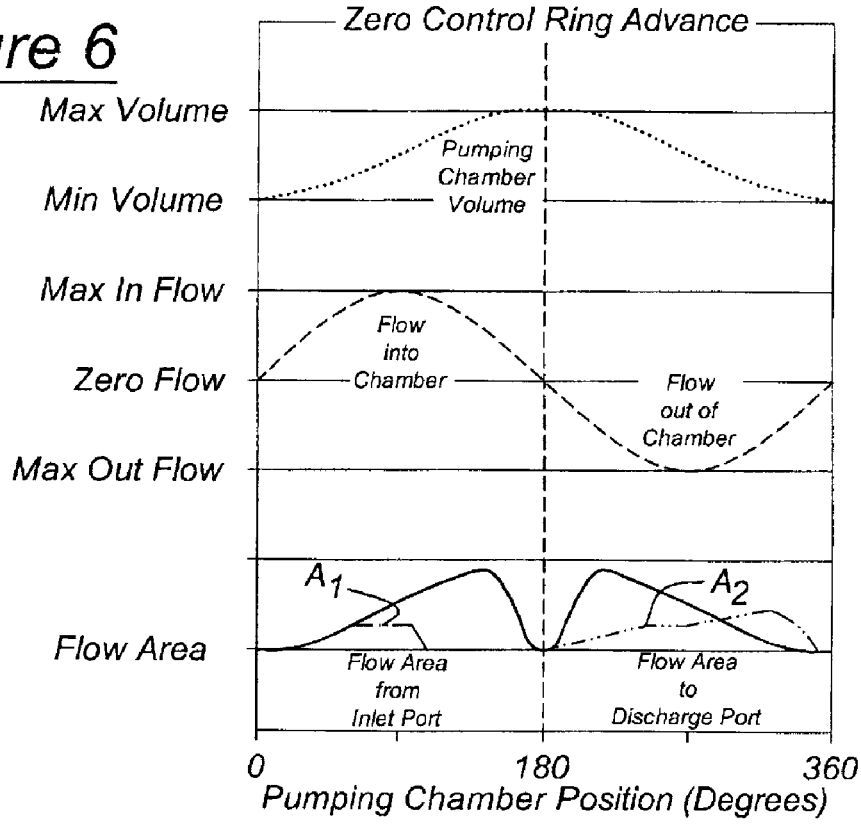
Figure 7:
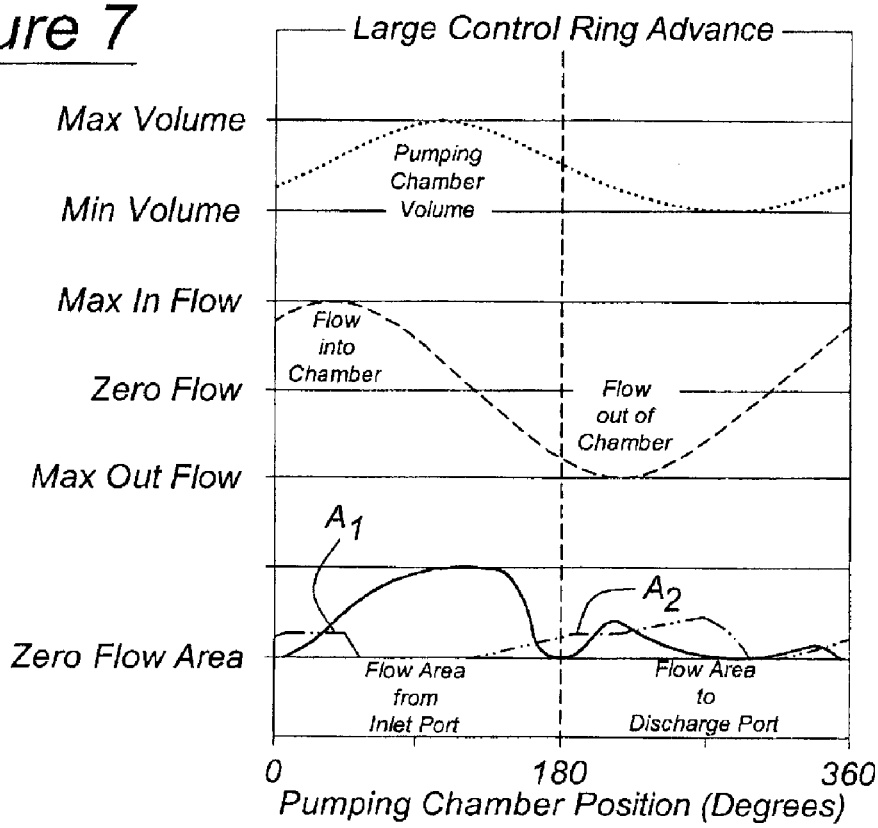

FIGS. 6, 7 and 8 show performance characteristics of the present gerotor pump with control ring advances of zero, large, and intermediate levels, respectively. FIG. 6 shows that with zero output control ring advance, the maximum pumping chamber volume is achieved as the pumping chamber passes the 180° position relative to the pump housing. Maximum inflow occurs at 90°, zero flow at 0° and 180° and maximum outflow at 270°. The inlet and outlet ports are situated in the housing so that there is minimal or zero flow area between the pumping chambers and the inlet and outlet ports at the 0° and 180° positions where the pumping chambers move from one port to the other.

When the output control ring is rotated to a large advance (FIG. 7), the maximum chamber volume occurs before 180° and maximum flow, inflow, zero flow and outflow points are correspondingly advanced relative to housing 16, inlet port 12, and outlet port 14.

FIG. 7 illustrates that when control ring 24 is advanced to a large extent, the pumping chambers pass from one port to the other, at the 0° and 180° positions relative to the housing, while they are changing in volume. If the pumping chambers were to be completely disconnected from both ports while changing in volume, large, undesirable pressure changes may occur within the pumping chambers. Pressure spikes may occur in the pumping chambers that are decreasing in volume, while cavitation may occur in the chambers that are increasing in volume.

To assure that the pumping chambers are never completely disconnected from both ports while the pumping chambers are undergoing a change of volume at the 0° and 180° positions, a plurality of radially extending slots, 44, is formed in the axial faces of outer rotor 42 to allow limited flow from each pumping chamber to outlet port 14 and/or to inlet port 12 via shunt passages 28 and 30 which are formed in upper and lower portions of output control ring 24. These shunt passages are formed in control ring 24 and have varying cross sectional flow areas which are intended to assure that the pumping chambers at the 0° and 180° positions have no direct communication with the shunt passages 28 and 30 when control ring 24 is at the zero advance (maximum pump output) position, but as control ring 24 is advanced to decrease the pump output, the pumping chambers at the 0° and 180° positions attain adequate flow passage area to the inlet and outlet ports to prevent the development of undesirable pressure spikes as well as cavitation. The shunt passage flow areas are shown at A1 and A2 of FIGS. 6-8. A1 corresponds to the shunt flow area to inlet port 12, and A2 corresponds to the shunt flow area to outlet port 14.

When output control ring 24 is in an advanced position, shunt passages 28 and 30 can provide a restricted leak path from the pump's outlet port 14 to inlet port 12. This leak path does not occur when output control ring 24 is at the zero advance position and maximum pump output is desired. If output control ring 24 were to be advanced by 90° from its zero advance (maximum output) position, the pump's output would diminish to zero. Because a running engine's lubrication requirement is never zero, there is no practical reason for constructing an engine's lubrication pump with the capability of advancing the output control ring to that extent, although there are other uses for gerotor pumps where zero, or near zero, output capability would be desirable.

Figure 2:
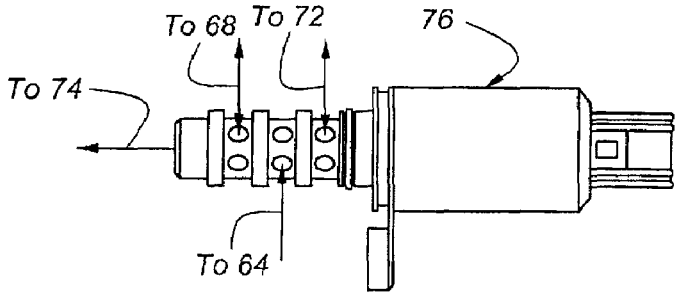
FIG. 2 illustrates a control valve used for controlling a gerotor pump according to the present invention.

FIG. 2 illustrates a control solenoid according to one aspect of the present invention. Solenoid valve 76 fits into valve port 62 which is formed in the body 16 of pump 10. Valve port 62 receives high pressure oil from outlet port 14 via high pressure supply passage 64 and can release oil to the engine's crankcase through oil passage 74. When it is desired to reduce the pump's output, solenoid valve 76 simultaneously supplies advance passage 68 with high pressure oil from high pressure supply 64 and relieves the retard passage 72 to discharge passage 74, so as to move torque arm 60 in the clockwise direction indicated in FIG. 4, from the at rest position of FIG. 1. Conversely, when it is desired to increase the pump's output, solenoid valve 76 simultaneously supplies retard passage 72 with high pressure oil from the high pressure supply 64 and relieves advance passage 68 to the discharge passage 74. When it is desired to maintain the pump's output at an existing setting, solenoid valve 76 closes all four passages and locks the fluid within the advance and retard sides of cavity 56. If solenoid valve 76 or its control system were to fail in this locked position, internal pump pressures and the viscous drag of the rotating gears within the pump would tend to rotate control ring 24 into a "fail safe' position of maximum pumping capacity.

Figure 10:
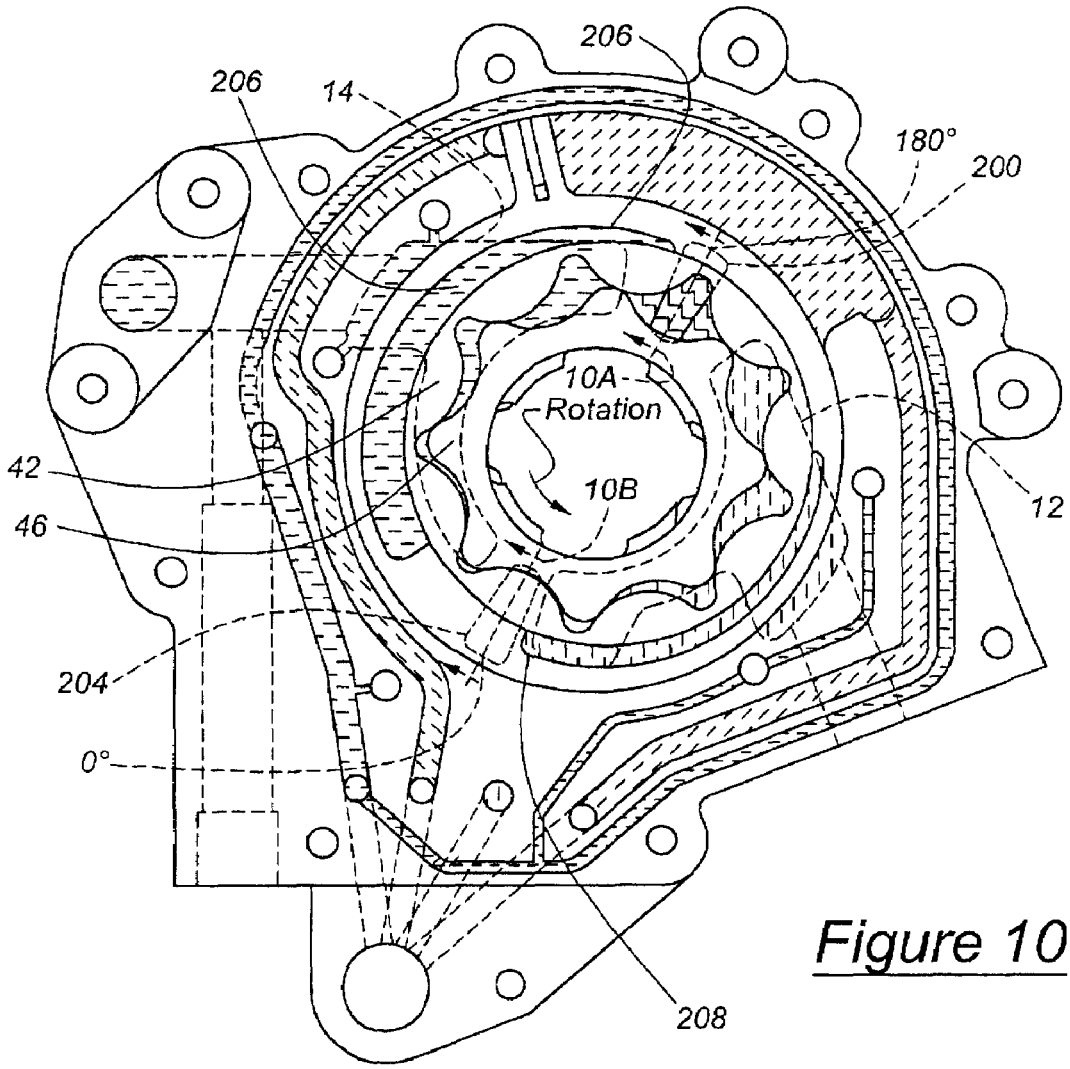
FIG. 10 illustrates a second embodiment of a gerotor pump according to the present invention in a maximum flow position.
Figure 10A:
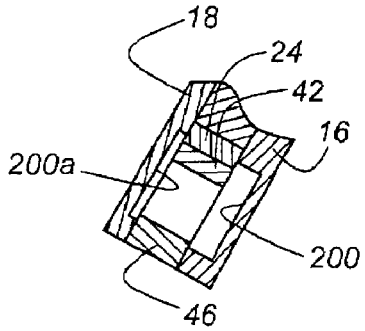
FIGS. 10A and 10B are sectional views taken through the pump of FIG. 10, along the lines A-A and B-B, respectively.
Figure 10B:
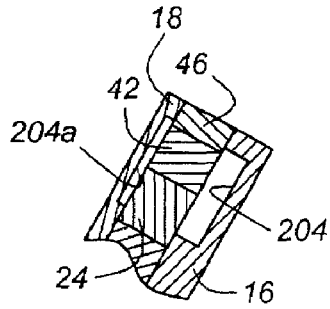
Figure 11:
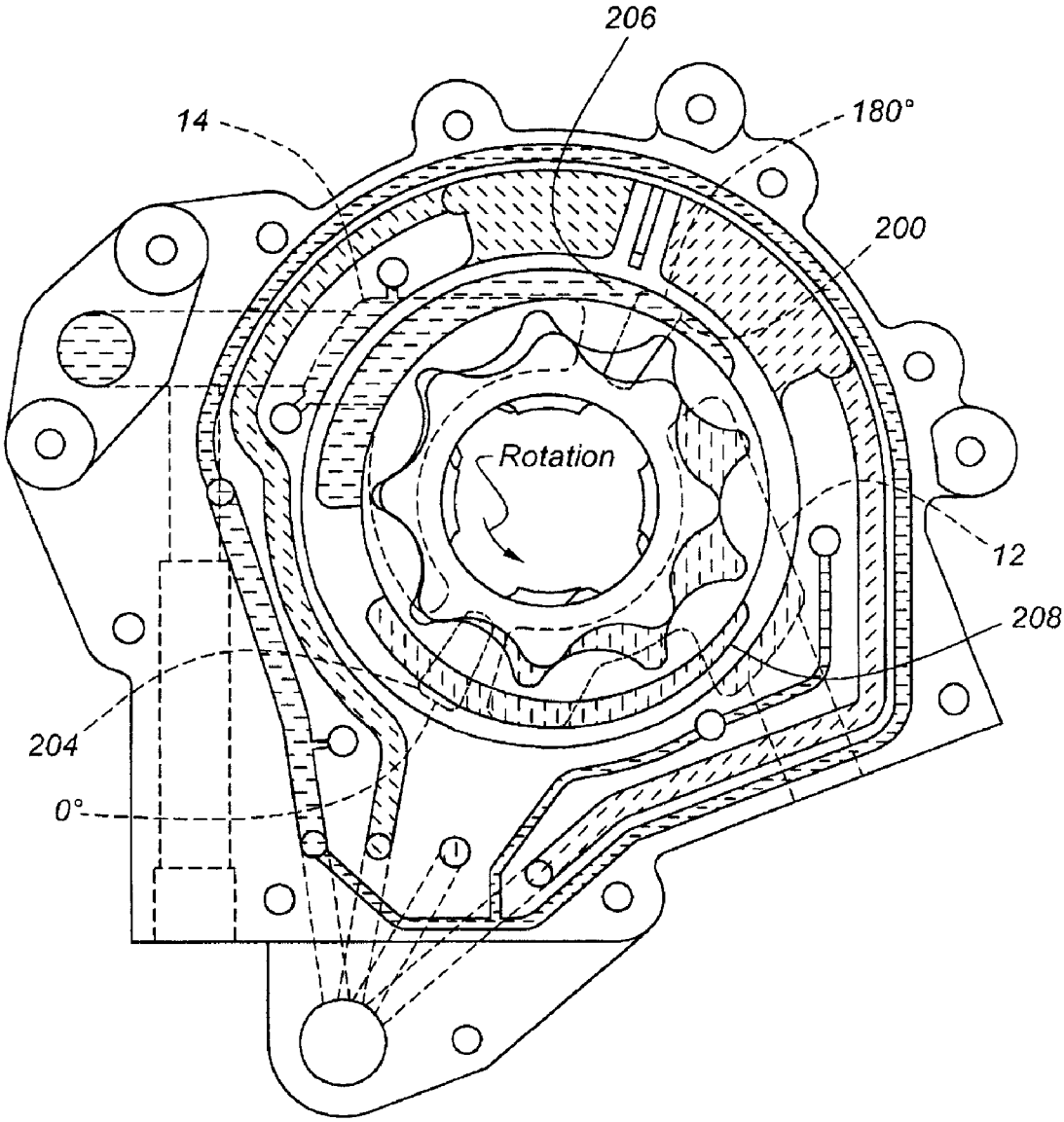
FIG. 11 illustrates the pump of FIG. 10 in an intermediate advance (flow) mode.
Figure 12:
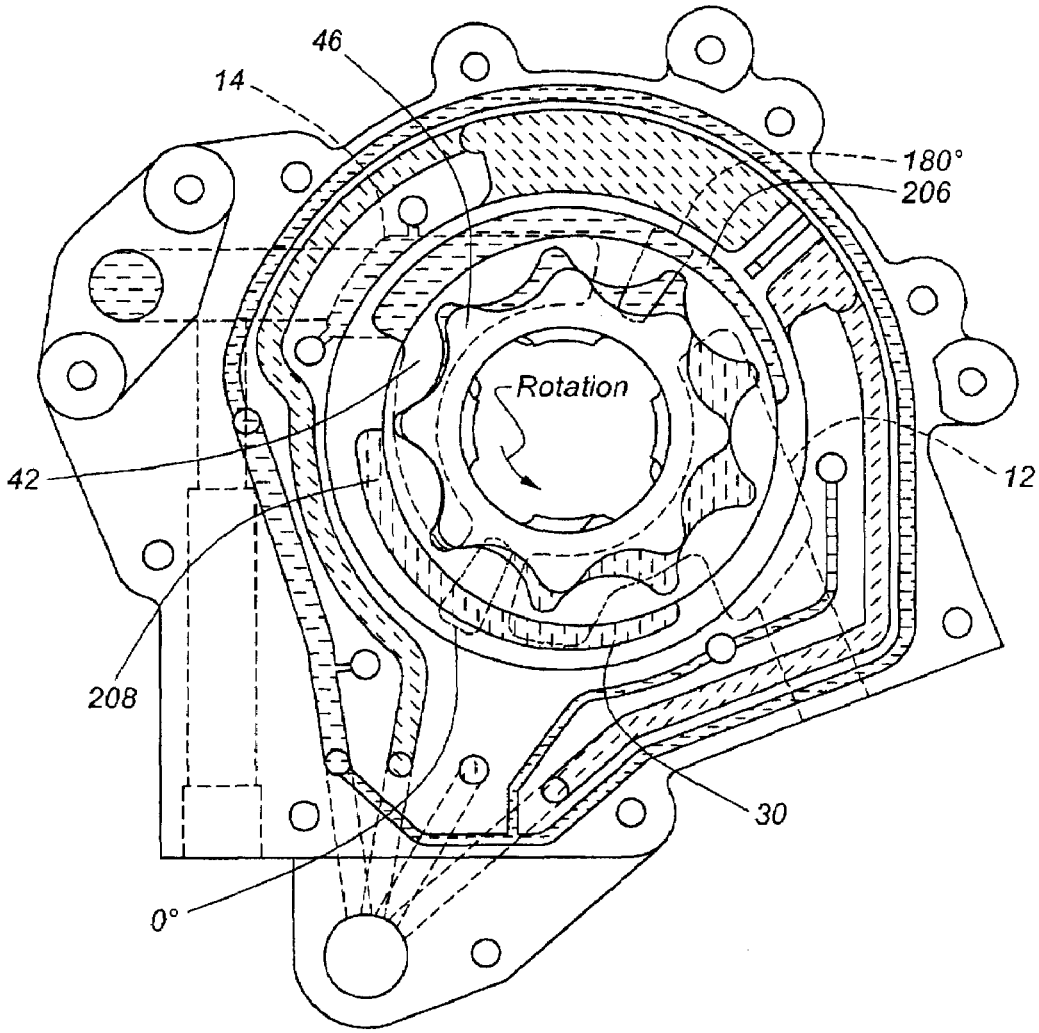
FIG. 12 illustrates the pump of FIG. 10 in a large output control ring advance position corresponding to a near minimum flow.

FIGS. 10-12 show a second embodiment of a pump according to the present invention, in which relief passages 200 and 204 allow selective communication between revised shunt passages 206 and 208 and the pump's inlet and outlet ports. Relief passage 200, which is formed as a pocket within pump body 16, is shown with greater specificity in FIG. 10A. Passage 200 extends radially from output control ring 24 to inner rotor 46. When output control ring is in the zero advance position illustrated in FIGS. 10, 10A, and 10B, flow cannot pass between the pumping chamber at 0° and shunt passage 208, nor between the pumping chamber at 180° and shunt passage 206. If however, the pump is adjusted as shown in FIGS. 11 and 12, communication is possible between the pumping chambers and shunt passages, but then only on an intermittent basis; there is no continuous flow of fluid from the outlet port to the inlet port. FIG. 11 corresponds to an intermediate control ring advance, and FIG. 12 corresponds to a large (near maximum) control ring advance.

Figure 13:
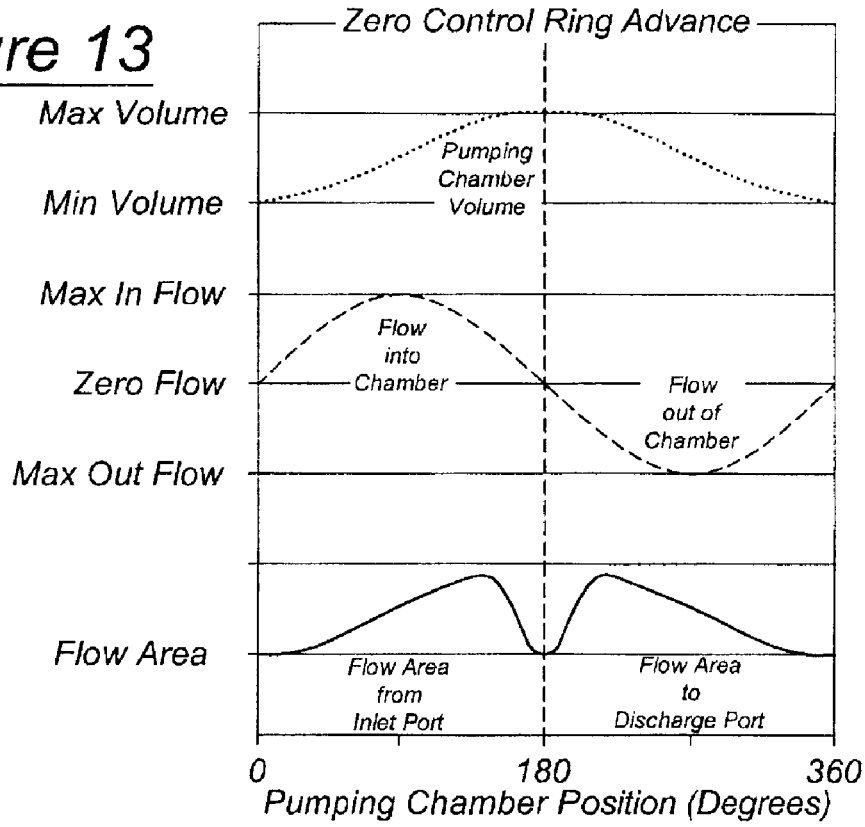
FIGS. 13-15 illustrate various operating characteristics of a pump according to FIGS. 10-12.
Figure 14:
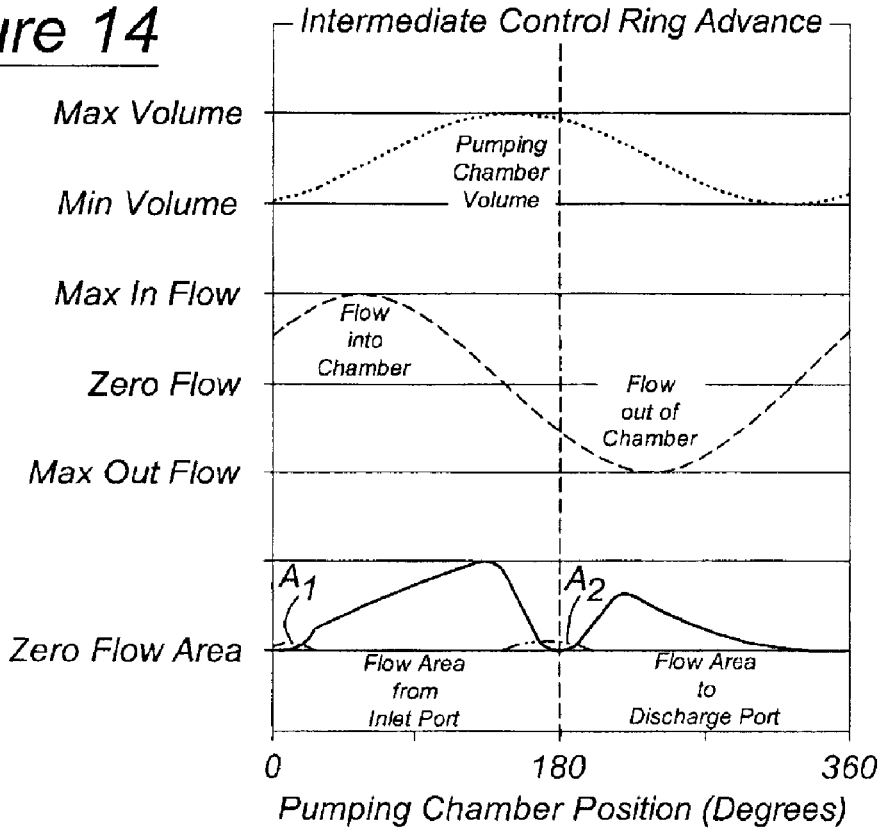
Figure 15:
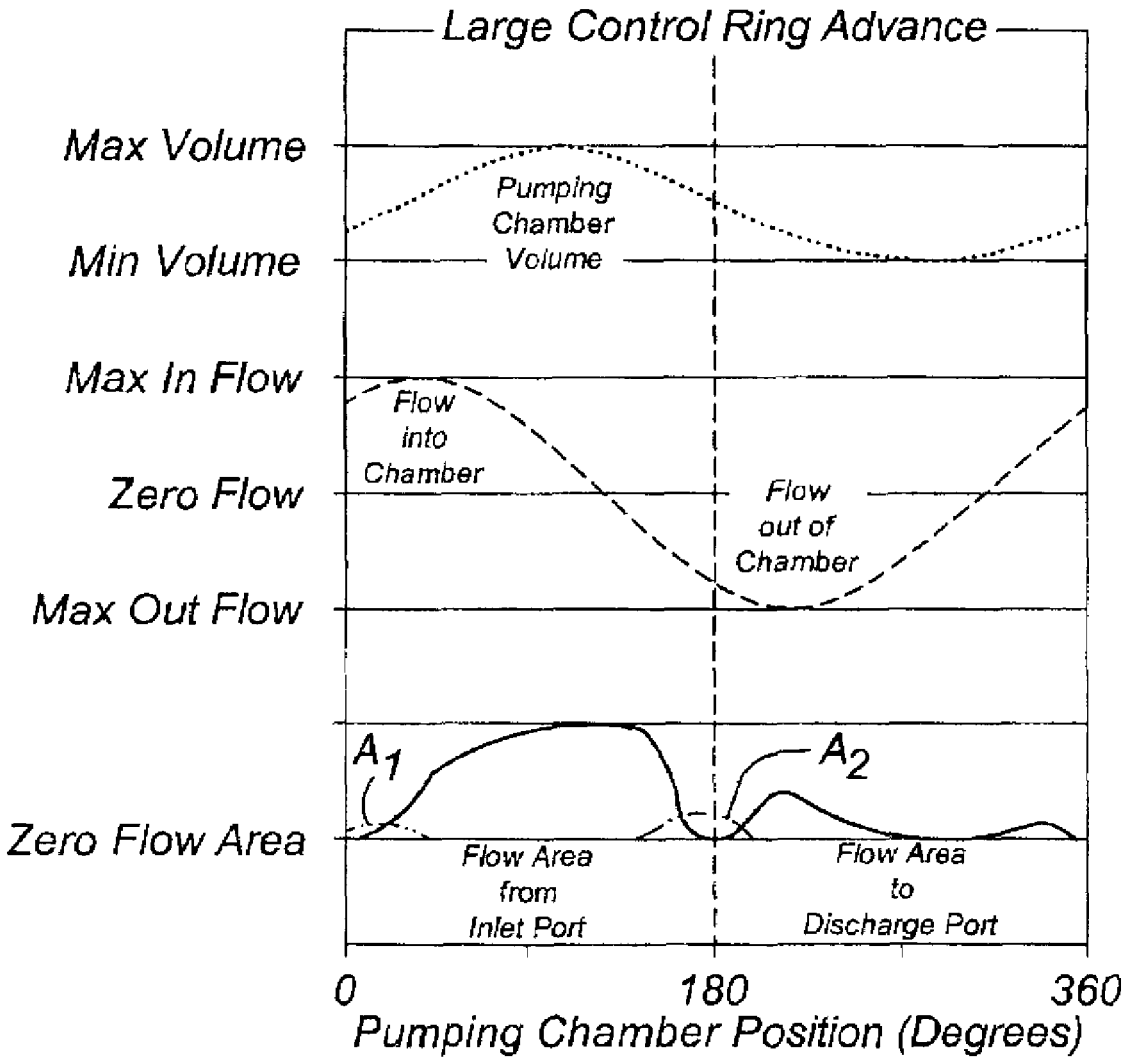

FIGS. 13-15 show various operational characteristics of the pump illustrated in FIGS. 10-12. FIG. 13, which corresponds to zero flow control ring advance, illustrates the flow conditions experienced by the pumping chambers as they travel through a complete rotation in the pump configuration shown in FIG. 10. In FIG. 10 it can be seen that the shunt passages 206 & 208 do not make contact with the relief passages 200 & 204, so the pumping chambers do not have any flow communication with the shunt passages 206 & 208 while they are passing through the relief passages 200 & 204 at the 0° and 180° positions. In this configuration, with zero advance of the output control ring 24, the pump has the same flow output as a conventional pump with the same size pumping elements 42 & 46.

FIG. 14 illustrates the flow conditions experienced by the pumping chambers as they travel through a complete rotation in the pump configuration shown in FIG. 11, which has an intermediate control ring advance. In FIG. 11 it can be seen that the shunt passages 206 & 208 do make contact with the relief passages 200 & 204, so that relief passage 200, at the 180° position, is connected to outlet port 14 through shunt passage 206, so as to allow limited flow from the pumping chamber to outlet port 14. Likewise, shunt passage 208 now allows limited flow from the inlet port 12 to the relief passage 204 and the pumping chamber passing through the 0° position. As before, A1 corresponds to the shunt flow area to inlet port 12, and A2 corresponds to the shunt flow area to outlet port 14.

FIG. 15 illustrates the flow conditions experienced by the pumping chambers as they travel through a complete rotation in the pump configuration shown in FIG. 12, which has a large control ring advance. Inspection of the effective flow area between the relief passages 200 & 204 and the shunt passages 206 & 208 shows that these effective flow areas at the 0° and 180° positions increase as the output control ring 24 is advanced, but direct leakage from the outlet port 14 and the inlet port 12 only occurs intermittently while a pumping chamber is in the process of transferring across the 0° or 180° position. This reduced leakage improves the efficiency of the pump as compared to the previously described configuration that allows the shunt passages to create a continuous leakage from the outlet port to the inlet port.

Although the present invention has been described in connection with particular embodiments thereof, it is to be understood that various modifications, alterations, and adaptations may be made by those skilled in the art without departing from the spirit and scope of the invention set forth in the following claims. As an example, the electronic pressure sensor and solenoid control valve could be replaced with a hydraulic control system.

What is claimed is:

1. A pressure lubrication system for an internal combustion engine comprising:

a source of lubricating oil;

an oil pressure sensor for generating a pressure signal;

a variable output gerotor oil pump for providing lubricating oil to the engine; and a controller operatively connected with said oil pump and said pressure sensor, with said controller operating said oil pump so as to control the flow rate of lubricating oil through said pump as a function of at least said pressure signal and engine speed.

2. A pressure lubrication system according to claim 1, with said controller operating said oil pump by controlling the rotational position of an output control ring by metering oil from a pump discharge port to a control cavity within which a control ring torque arm is located.

* * * * *